US005625368A

United States Patent [19]

Howson et al.

[11] Patent Number: 5,625,368

[45] Date of Patent: Apr. 29, 1997

[54] RADIOWAVE ANTENNA SYSTEM

[75] Inventors: Christopher Howson, Strasbourg, France; Masahiro Fujimoto, Kawasaki, Japan; Patrice Fremanteau; David Harrison, both of Strasbourg, France

[73] Assignee: Thomson Consumer Electronics, S.A., Courbevoie, France

[21] Appl. No.: 150,903

[22] Filed: Nov. 12, 1993

Related U.S. Application Data

[63] Continuation of PCT/EP92/01023, May 9, 1992.

[30] Foreign Application Priority Data

May 13, 1991 [EP] European Pat. Off. ..... 91401231

[51] Int. Cl.[6] ..... H01Q 19/06; H01Q 1/36

[52] U.S. Cl. ..... 343/753; 343/895; 343/840; 343/911 L

[58] Field of Search ..... 343/753, 754, 343/755, 840, 895, 911 L, 911 R, 909, 781 R

[56] References Cited

U.S. PATENT DOCUMENTS

| | | | |
|---|---|---|---|
| 3,184,249 | 5/1965 | Käch | 343/840 |
| 3,255,452 | 6/1966 | Walter et al. | 343/753 |
| 3,487,413 | 12/1969 | Shores | 343/754 |
| 4,178,576 | 12/1979 | Schmidt, Jr. et al. | 343/840 |
| 4,287,519 | 9/1981 | Doi | 343/911 L |
| 4,742,359 | 5/1988 | Ishino et al. | 343/840 |
| 5,202,699 | 4/1993 | Hemmie et al. | 343/840 |
| 5,225,668 | 7/1993 | Hilliard et al. | 343/911 L |

FOREIGN PATENT DOCUMENTS

| | | | |
|---|---|---|---|
| 0304656 | 7/1988 | European Pat. Off. | H01Q 3/18 |
| 1918084 | 4/1969 | Germany | H01Q 19/12 |
| 2263806 | 7/1973 | Germany | 343/911 L |
| 3521035 | 6/1985 | Germany | H01Q 19/12 |
| 2208189 | 3/1989 | United Kingdom | H01Q 1/12 |

*Primary Examiner*—Donald T. Hajec
*Assistant Examiner*—Tan Ho
*Attorney, Agent, or Firm*—Joseph S. Tripoli; Frederick A. Wein; Eric P. Herrmann

[57] ABSTRACT

An antenna system for receiving radiowaves includes a Lundeburg-type lens which reflects radiowaves to a focal point of the lens. A helical primary feed is located in the proximity of the focal point. Electronic circuitry for processing the radiowaves in a desired manner and the primary feed are supported in a hollow support structure in the proximity of the focal point.

6 Claims, 3 Drawing Sheets

RADIOWAVE ANTENNA SYSTEM

This is a continuation of PCT application PCT/EP 92/01023, filed May 9, 1992 by Christopher Howson, Masahiro Fujimoto, Patrice Fremanteau and David Harrison and titled "RADIOWAVE ANTENNA SYSTEM ".

BACKGROUND OF THE INVENTION

The present invention relates to an antenna system including a radiowave concentration means, like a reflector, a lens or the like, and a primary feed antenna, which is located at a focal point, where incoming radiowave beams are concentrated.

It is generally known, to use antenna systems, which include a parabolic reflector and a feed horn provided at the focal point of the parabolic reflector, for receiving radiowave signals.

From U.S. Pat. No. 4,742,359 it is known, that said feed horn can be replaced by a helical antenna with two ends whereby the first end is linked to a feeder line. For the purposes of the following explanation it is understood that the said feeder line is aligned with the axis of the said helical antenna. Such a helical antenna may be built as a so-called endfire helical antenna, where under maximum received power conditions the direction of the signal power flow at the said first end is in the same direction as the received radiation. Such a helical antenna can also be built as a so-called backfire helical antenna, where under maximum received power conditions the direction of the signal power flow at the said first end is in the opposite direction to the received radiation.

In the said U.S. patent an antenna system is presented, which comprises a reflector, a primary helical antenna having a coil with a pair of ends, said coil located at the focal point of said reflector so that the axis of the helical antenna coincides essentially with the axis of said reflector. A feeder line couples the antenna system with an external circuit, so that primary helical antenna represents a backfire helical antenna coupled with said feeder line at the nearer end from said reflector and the other end of the helical antenna is free standing, and said feeder line is a coaxial cable.

A typical semi-rigid coaxial cable has an insertion loss of 1.5 dB/m at a frequency of 12 GHz, which is used for current direct reception of satellite TV-signals. In systems, which are state of the art, a length of nearly 8.1 meter is required, for a reflector of a diameter of 40 centimeter, resulting in a total cable loss of nearly 0.15 dB. This value adds directly to the noise figure of the antenna system (typically less than 1.4 dB) and will be substantially higher at higher frequencies, such as the 22 GHz band proposed for future satellite TV systems.

It is an object of the present invention to provide a compact antenna system, for receiving electromagnetical, preferably microwave, signals, where the use of a feeder line for microwaves between a primary feed antenna and external circuits can be reduced to a great extent or even be avoided.

The antenna system according to the present invention includes a concentration means, such as a reflector, e.g. parabolic, or a microwave lens, e.g. Luneburg-like. The said concentration means concentrates received microwave beams at one focal point or at several focal points respectively and at each of these focal points a primary feed is provided, which is supported by a hollow structure, which may be tubular, circular, rectangular, or the like. This structure houses electronic means, e.g. a low noise converter (LNC), which convert, filter and/or amplify signals received by the said primary feeds.

By arranging the electronic means inside the tubular structure the use of expensive feeder lines, such as a semi-rigid coaxial cable, can be reduced to a great extent or even be avoided. Additionally respective links or connectors can be avoided. The antenna system according to the invention allows fewer mechanical parts, a lighter weight, and reduced costs relative to the prior art.

Additionally insertion losses of such a cable can be reduced or avoided respectively, whereby the noise figure will be improved and the performance of the antenna system can be increased.

If the tubular structure is provided with an adjustment mechanism the feed position can be changed to suit concentration means with different focal points, e.g. by the use of reflectors of different diameters.

The use of helical coils has the advantage that they can be changed very easily, whereby the reception of signals with right-hand or left-hand circular polarization is possible.

The use of backfire helical antennas has the advantage that such an antenna system is quite compact.

If parts of the said electronic means are integrated and realized as part of an integrated circuit, e.g. as Monolithic Microwave Integrated Circuit, or as part of a hybrid circuit, space and more costs can be saved.

As especially in known systems using a microwave reflector, the quantity of feeder line needed is high, this invention can preferably replace such systems.

BRIEF DESCRIPTION OF THE DRAWINGS

Further features, advantages and details of the present invention will be explained by means of the following description of embodiments and accompanying drawings, wherein.

DETAILED DESCRIPTION OF THE PREFERRED EMBODIMENT

Figure 1:
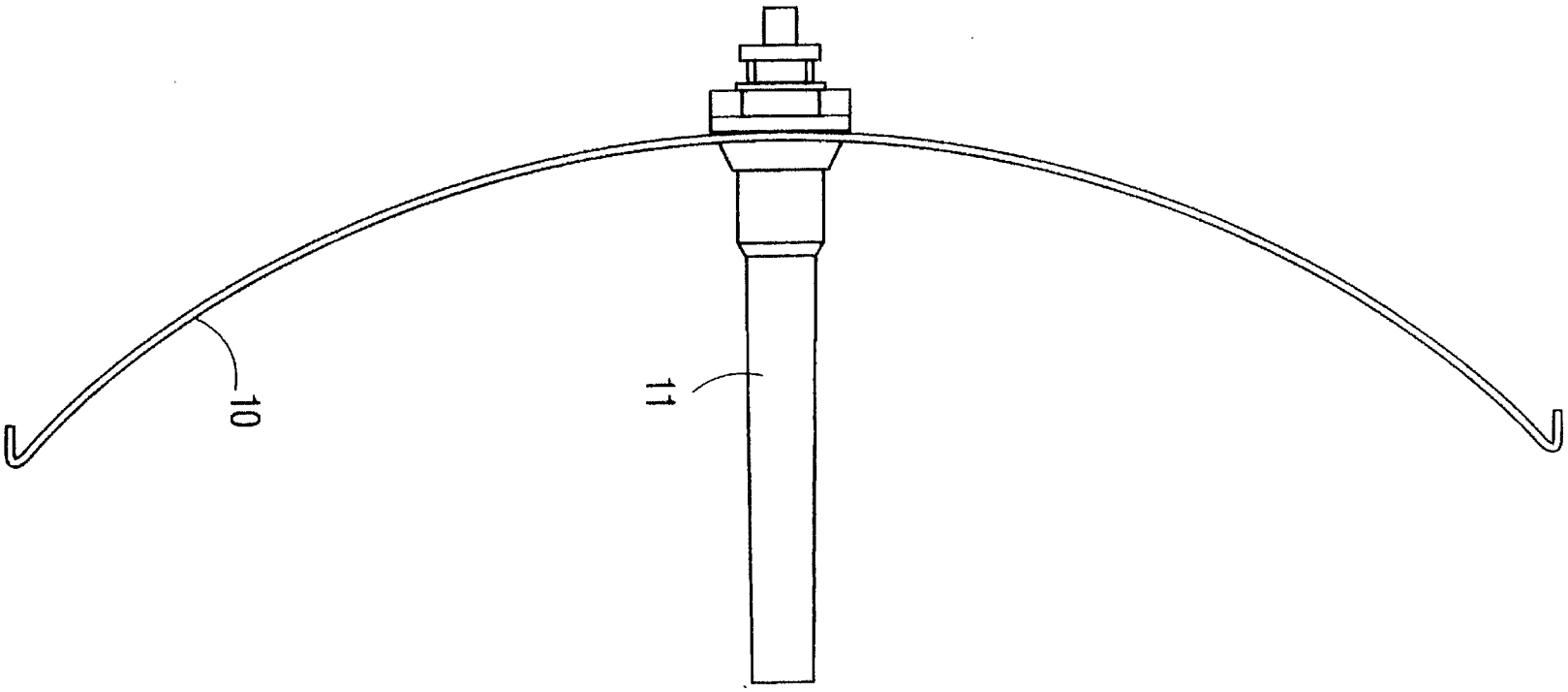
FIG. 1 shows a first embodiment of the inventive antenna system using a parabolic reflector.
Figure 2:
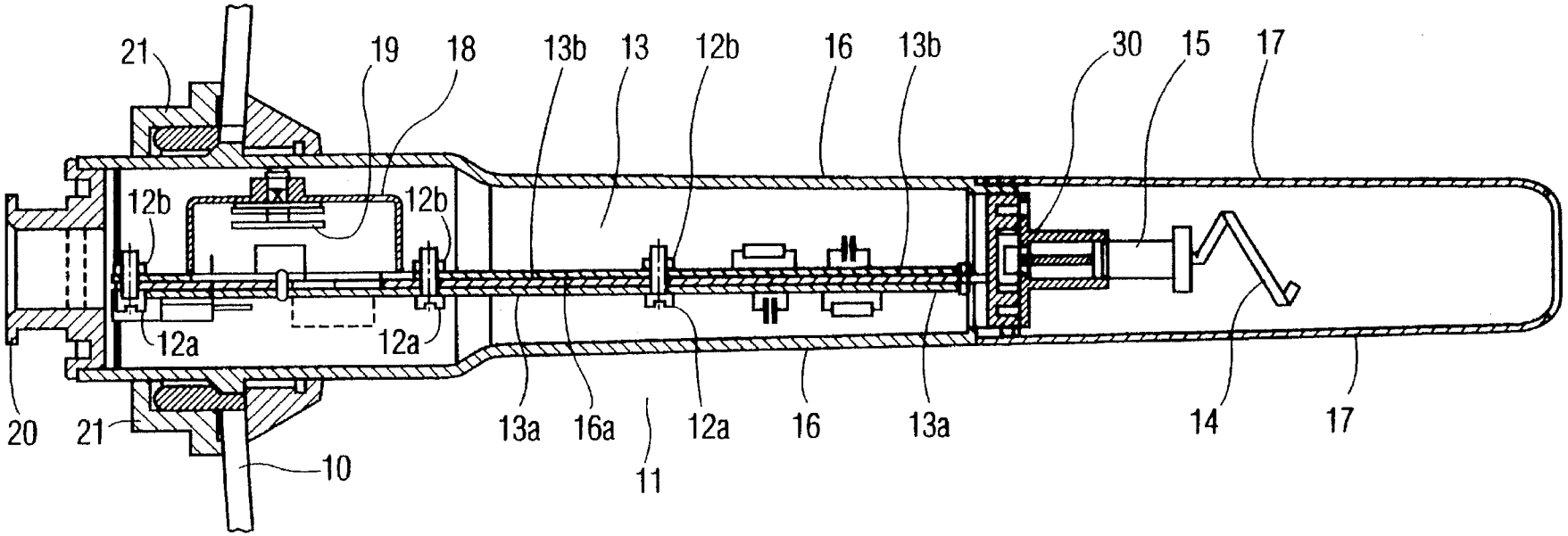
FIG. 2 shows details of the support structure used.

FIG. 1 shows a first embodiment of the invention using a parabolic reflector 10 at which a tubular structure 11 is arranged, which is shown in detail in FIG. 2.

FIG. 2 shows the tubular structure 11 housing electronic means 13, like a low noise converter, with electronic components on a lower printed circuit board **13*a* and on a upper printed circuit board 13*b*, which are preferably arranged back-to-back. A primary feed 14, which is realized in this embodiment as a backfire helical antenna, is enclosed in a plastic radome 17 and connected via a line 15 to the electronic means 13**.

The tubular structure consists of a metal tubular support 16, which houses the electronic means 13 and which includes also a metal plate **16*a*. This plate 16*a* is arranged between the printed circuit boards 13*a* and 13*b*, which are fastened with several screws 12*a* und nuts 12*b***.

Critical electronic components, which e.g. can be influenced easily by outer radiation or which transmit radiation, are protected by a housing 18, which is soldered to the upper printed circuit board 13b. In this embodiment the critical electronic components are part of an oscillator and its frequency can be changed by an adjustment arrangement 19, which is provided in the upper part of the housing 18.

The input signal from the primary feed 14 is amplified, filtered and/or converted by the electronic means 13 and an according output signal is led via an output connector 20 to further not shown devices.

To adjust the position of the primary feed 14 in dependence on the concentration means used, in this embodiment the reflector 10, an adjustable mounting 21 is provided. This can be realized as a simple screw thread adjustment or as any other well known adjustment device.

Preferably the primary feed 14 is fixed to a carrier 30, which can be linked to the tubular support 16 and includes means for an electrical contact between the primary feed 14 and the electronic means 13.

The carrier 30 can be exchanged very easily so that several kinds of primary feeds can be installed.

Figure 3:
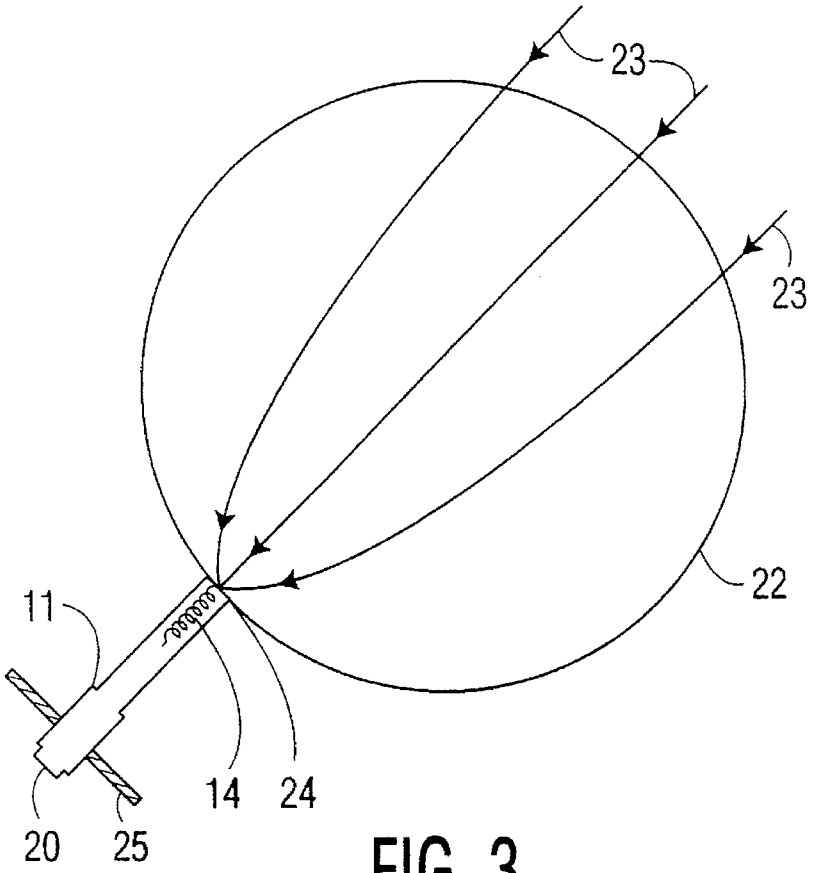
FIG. 3 shows a second embodiment using a spherical Luneburg-type lens and an endfire helical primary feed.
Figure 4:
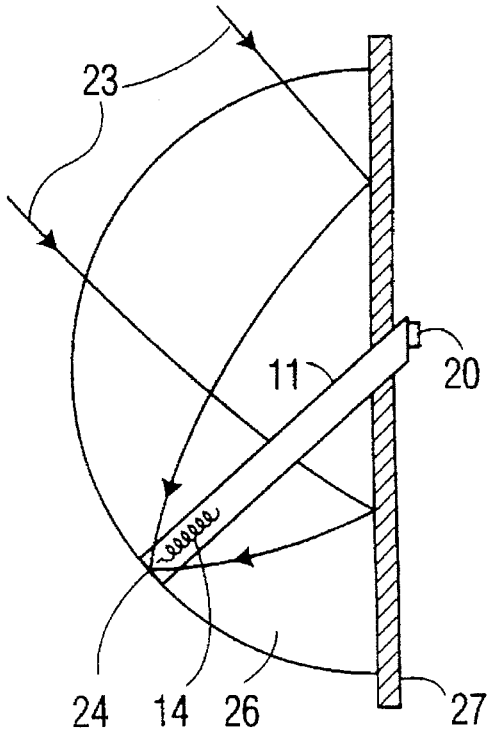
FIG. 4 shows a third embodiment using a hemi-spherical Luneburg-type lens and a backfire helical primary feed.

FIG. 3 and FIG. 4 show further embodiments using Luneburg-type lenses. Means with the same function as in the first embodiment, described with the aid of FIG. 1 and FIG. 2, have got the same reference numbers and will be described only as far as it is necessary for the understanding of the present invention.

FIG. 3 shows in principle a second embodiment of this invention. A spherical Luneburg lens 22 refracts an incoming beam 23 at a focal point 24.

The tubular structure 11 is arranged outside the Luneburg lens in such a way that the primary feed 14, which is realized as an endfire helical antenna, is located near the focal point 24. The tubular structure 11 is fastened at means for supporting 25, which are just indicated.

In this embodiment nearly any type of feed is possible: feed horns, polyrod feeds, patch antenna feeds, Vivaldi antenna feeds, etc.

FIG. 4 shows in principle a third embodiment using a hemi-spherical Luneburg lens 26, which is attached to a metal-plate 27. This plate 27 reflects the incoming beam 23 and the hemi-spherical Luneburg lens 26 refracts it at the focal point 24.

The tubular structure 11 is arranged inside the hemi-spherical Luneburg lens in such a way that the primary feed 14, which is realized as a backfire helical antenna, is located near the focal point 24.

The tubular structure 11 is fastened at the metal-plate 27. As well in the second embodiment as in the third embodiment the refraction-index of the lens used 22, 26 may be varied so that the corresponding focal point 24 is located inside or outside of the lens-surface. Thereby the strength of the received signal can be improved.

On the other hand the position of the primary feed 14 may be varied, whereby the signal strength can be improved.

It may be mentioned that with the embodiments described with the aid of FIG. 1 and FIG. 4 the variation of feed type is limited by the necessity for the feed to be situated at the end of the support, but receiving the radiation focussed by the concentration means 10, 22 respectively. Other examples for appropriate feeds are a primary dipole antenna, a ring-focus feed, and a "short-backfire" antenna.

Due to reasons of clearness the adjustable mounting 21 is not indicated in FIG. 3 and FIG. 4. It should be mentioned that such a mean can be provided to adjust the position of the feed 14 in relation to the position of the focal point 24.

In versions of the antenna systems according to FIG. 3 and FIG. 4, which may be used for the reception of several microwave beams, several primary feeds may be provided. These feeds are located at or near the focal points of the beams to be received and one or more of the said primary feeds are supported by a common hollow structure and/or by separate ones, which house corresponding electronic means.

In a version of the said embodiments the means for concentration may include or may be built of a grating which diffracts incoming radiowaves. As primary feed antenna may be taken any of the said ones.

The present invention presents a radiowave, especially a microwave antenna system, which includes means for the concentration of said means, like a parabolic reflector or a Luneburg-type lens.

A primary feed, which receives the concentrated microwaves, is supported by a tubular structure. This tubular structure houses electronic means, such as a low noise converter (LNC).

For the embodiments of FIG. 1 and FIG. 4 the primary feed helix must operate in a backfire mode. In these cases the invention is very advantageous, as the elimination or reduction of the feeder line to a great extent results in improved performance and lower costs. The compact electronic means in the support allow fewer mechanical parts, a lighter weight, and reduced cost relative to the prior art.

The embodiment according to FIG. 3 is more compact, mechanically simpler, and lighter than conventional designs.

By the arrangement according to the invention, the length of a needed feeder line can be reduced, or such a line can even be avoided. Thereby time and money for the assembly can be saved, and the performance is improved. Also the mechanical parts are cheaper, simpler, and lighter. And space needed for the installation is reduced, as no converting means are behind a reflector.

Further versions of the said embodiments may include at least one of the following variations:

- the primary feed 14 is connected to the electronic means by a simple coaxial construction using a dielectric support pressed into place and carrying a centre conductor sprung to accept the centre conductor of the feed. In this way feeds may be easily exchanged to suit different satellites, and a test connector may be connected as required. Typical feed types are the helical feed and microstrip feeds;
- the electronic means may be realised such as a low noise amplifier (LNA), a band pass filter (BPF), and a monolithic microwave integrated circuit (MMIC) may be located on one circuit board and power supply components are located on another circuit board. By using a MMIC the number (ca. 50) of discrete components can be reduced and thereby the size of electronic means can be reduced;
- the LNA can use two high electron mobility transistors (HEMT) to achieve a very low noise figure;
- the BPF can be realised as parallel coupled microstrip line filter and can be rotated through some degrees, e.g. 30 degrees, to minimise length;
- the components used may be of the surface mount (leadless) type to minimise size.

Additionally it may be mentioned that the use of the invention together with a lens, like homogeneous-type lens, Luneburg-type lens or so, for receiving signals from different sources, as satellites, has the advantage that said sources may be close together. When using a lens with offset focal point at a distance of 2 times radius of lens (this is considered as optimum when considering size/weight of lens, directivity/size of feed and dimensions of LNC), signals from satellities as close together as 3 degrees can be received.

For use with lens type antennas the invention is of optimal shape for mounting radially to the lens. For multiple source applications (e.g. multiple satellites in geostationary orbit) the compact, radially mounted nature enables multiple versions of the invention to be located at closely spaced focal points.

We claim:

1. An antenna system for the reception of radiowaves, with a radiowave concentration means which concentrates by reflection, refraction and/or by diffraction radiowave beams in at least one focal point, said antenna system comprising:

a helical primary feed located at said focal point, said helical primary feed being a backfire helical antenna;

electronic means for converting, filtering and/or amplifying signals corresponding to said received radiowaves and which are disposed in a hollow housing which supports said primary feed, said concentration means providing a hemispherical microwave lens, and said hollow housing being disposed between the reflecting side of said microwave lens and said focal point.

2. An antenna system according to claim 1, wherein a carrier is provided inside the hollow housing, said primary feed is fixed to said carrier, and said carrier includes means for an electrical contact between said primary feed and said electronic means to enable exchangeability between several kinds of primary feeds.

3. An antenna system according to claim 1 wherein the hollow housing is mounted in a hole of the reflecting portion of said concentration means.

4. Antenna system according to claim 1 wherein parts of the electronic means are integrated and are part of a hybrid or integrated circuit.

5. Antenna system according to claim 1 wherein an adjustment mechanism enables the primary feed position to be changed.

6. An antenna system for the reception of radiowaves, with a parabolic reflector as a radiowave concentration means, which concentrates by reflection radiowave beams in at least one focal point, said antenna system comprising:

a helical primary feed located at said focal point, said helical primary feed being a backfire helical antenna and electronic means for converting, filtering and/or amplifying signals corresponding to said received radiowaves and which are disposed in a hollow housing, said hollow housing being of tubular form and at its first end being close to said parabolic reflector, said housing at its second end being provided with a carrier and being fixed to and supporting and extending to said primary feed, said carrier being linked exchangeably to said tubular housing and including means for an electrical contact between said primary feed and said electronic means to enable exchangeability of said carrier for installing various types of primary feeds.

* * * * *